US005696517A

United States Patent [19]

Kawahata et al.

[11] Patent Number: 5,696,517

[45] Date of Patent: Dec. 9, 1997

[54] SURFACE MOUNTING ANTENNA AND COMMUNICATION APPARATUS USING THE SAME

[75] Inventors: Kazunari Kawahata; Ken Okada, both of Kyoto, Japan

[73] Assignee: Murata Manufacturing Co., Ltd., Japan

[21] Appl. No.: 716,697

[22] Filed: Sep. 17, 1996

[30] Foreign Application Priority Data

Sep. 28, 1995 [JP] Japan ..... 7-251039

[51] Int. Cl.[6] ..... H01Q 1/36; H01Q 1/24

[52] U.S. Cl. ..... 343/700 MS; 343/702; 343/873; 343/846

[58] Field of Search ..... 343/700 MS, 846, 343/848, 702, 873, 895, 749; H01Q 1/36, 1/24

[56] References Cited

U.S. PATENT DOCUMENTS 5,537,123 7/1996 Mandai et al. ..... 343/700 MS 5,541,616 7/1996 Kawahata et al. ..... 343/702

5,581,262 12/1996 Kawahata et al. ..... 343/700 MS 5,588,198 12/1996 Kawahata et al. ..... 343/767

*Primary Examiner*—Hoanganh T. Le

*Attorney, Agent, or Firm*—Ostrolenk, Faber, Gerb & Soffen, LLP

[57] ABSTRACT

A surface mounting antenna in which easy formation of a radiation electrode can be achieved by forming it on the surface of a substrate, and also the antenna can be downsized by bending the radiation electrode. A communication apparatus using the above antenna is also disclosed. A ground terminal and a feeding terminal are separately disposed on one lateral surface. A loading capacitor electrode is formed on another lateral surface opposedly facing the surface on which the ground terminal and the feeding terminal are disposed. A stripline radiation electrode is further formed on the obverse surface of the substrate and is connected at the respective ends to the ground terminal and the loading capacitor electrode. A feeding electrode for connecting the matching portion of the radiation electrode and the feeding terminal is disposed on the obverse surface of the substrate.

32 Claims, 5 Drawing Sheets

SURFACE MOUNTING ANTENNA AND COMMUNICATION APPARATUS USING THE SAME

BACKGROUND OF THE INVENTION

1. Field of the Invention

The present invention relates to a surface mounting antenna for use in mobile communication apparatus, such as mobile cellular telephones and radio Local Area Networks (LAN). The invention also relates to a communication apparatus using the above type of antenna.

2. Description of the Related Art

Referring to FIG. 9, a typical surface mounting antenna of a known type generally indicated by 20 has a substrate 21. A ground terminal 22 and part of a feeding terminal 23 are disposed on one lateral surface 21*a* of the substrate 21. The remaining feeding terminal 23 is provided on another lateral surface 21*c* adjacent to the lateral surface 21*a*. A loading capacitor electrode 24 is disposed on a lateral surface 21*b* opposedly facing the lateral surface 21*a*. A through hole 25 is formed between the opposedly-facing surfaces 21*a* and 21*b* so as to receive a radiation electrode 25*a* therein. This radiation electrode 25*a* is electrically connected to both the ground terminal 22 and the loading capacitor electrode 24. Further, a through hole 26 is formed from the lateral surface 21*c* to the through hole 25 so as to receive a feeding electrode 26*a* therein. The feeding electrode 26*a* is electrically connected to both the feeding terminal 23 and the radiation terminal 25*a*.

The surface mounting antenna 20 constructed as described above is placed on a printed circuit board 27 on which electrodes 27*a* and 27*b* are disposed. The ground terminal 22 and the feeding terminal 23 are then soldered to the electrodes 27*a* and 27*b*, respectively.

A high-frequency signal applied to the radiation electrode 25*a* via the electrode 27*b*, the feeding terminal 23 and the feeding electrode 26*a* is radiated as radio waves from the radiation electrode 25*a*. Radio waves impinging on the radiation electrode 25*a* are transmitted to a high-frequency amplifying section (not shown) via the feeding terminal 23 and the electrode 27*b*.

The surface mounting antenna 20 of the above known type requires the provision of the two through holes 25 and 26 and further necessitates complicated means for forming the radiation electrode 25*a* and the feeding electrode 26*a* in the respective holes 25 and 26, thus leading to an increase in cost. In particular, the radiation resistance and the reactance component of the radiation electrode 25*a* formed within the through hole 25 are generated and determined depending on the diameter of the hole 25. The diameter of the through hole 25 can be decreased to enhance the effect of the shorter wavelength, so that the antenna can be downsized, but on the other hand, this makes it difficult to form the radiation electrode 25 within the through hole 25. Hence, there is a limitation on downsizing the antenna, which further restricts the determination of the characteristic parameters. Restrictions are also imposed on the shape of a hole which is only limited to a straight hole, thus making it impossible to form the radiation electrode in an elongated shape or in different shapes. Additionally, a conventional communication apparatus integrated with the surface mounting antenna of the above known type accordingly presents the problem that the housing for the apparatus cannot be downsized.

SUMMARY OF THE INVENTION

Accordingly, it is an object of the present invention to provide a surface mounting antenna in which easy formation of a radiation electrode can be achieved by forming it on the obverse surface of a substrate, and the radiation electrode is further bent so as to downsize the antenna, and also to provide a communication apparatus using the above type of surface mounting antenna.

In order to achieve the above object, according to one aspect of the present invention, there is provided a surface mounting antenna comprising: a substrate formed of a dielectric member or a magnetic member; a radiation electrode disposed on one main surface of the substrate and having a matching portion; a feeding electrode disposed on the main surface of the substrate and directly connected to the matching portion of the radiation electrode or capacitively coupled to the matching portion via a gap; a loading capacitor electrode disposed on one lateral surface of the substrate and connected to one end of the radiation electrode; a ground terminal disposed on any one of the lateral surfaces other than the lateral surface on which the loading capacitor electrode is disposed, and connected to the other end of the radiation electrode; and a feeding terminal disposed on at least one lateral surface other than the lateral surface on which the loading capacitor electrode is disposed, and connected to the feeding electrode.

According to another aspect of the present invention, there is provided a surface mounting antenna comprising: a substrate formed of a dielectric member or a magnetic member; a radiation electrode disposed on one main surface of the substrate and having a matching portion; a feeding electrode disposed on the main surface of the substrate and directly connected to the matching portion of the radiation electrode or capacitively coupled to the matching portion via a gap; a loading capacitor electrode disposed on one lateral surface of the substrate and connected to one end of the radiation electrode; a ground terminal disposed on the lateral surface on which the loading capacitor electrode is disposed and connected to the other end of the radiation electrode; and a feeding terminal disposed on the lateral surface on which the loading capacitor electrode is disposed and connected to the feeding electrode.

According to still another aspect of the present invention, there is provided a surface mounting antenna in which the radiation electrode may be formed in the shape of a stripline, "U", meandering or a crankshaft.

According to a further aspect of the present invention, there is provided a surface mounting antenna comprising: a substrate formed of a dielectric member or a magnetic member; a radiation electrode disposed on a first lateral surface of the substrate; a feeding electrode disposed in the inner periphery of a through hole formed between the first lateral surface and a second lateral surface opposing the first lateral surface; a loading capacitor electrode disposed on a lateral surface adjacent to the first lateral surface and connected to one end of the radiation electrode; a ground terminal disposed on another lateral surface adjacent to the first lateral surface and connected to the other end of the radiation electrode; and a feeding terminal disposed on at least the first lateral surface and connected to the feeding electrode.

The present invention also provides a communication apparatus loaded with any one of the surface mounting antennae according to the above-described aspects of the present invention.

In this manner, according to the present invention, a radiation electrode is formed in the shape of a stripline or meandering on a main surface or a lateral surface of a substrate, thus making it possible to shorten the wavelength.

A loading capacitor electrode is disposed on a lateral surface of the substrate so as to further shorten the wavelength, thereby enhancing the downsizing of the antenna. Further, the radiation electrode is bent to reduce the chip size of the antenna to a greater degree. Additionally, the radiation electrode is disposed on the obverse surface of the substrate and the loading capacitor electrode is provided on the lateral surface, thereby enhancing easy adjustment of the characteristics of the antenna, such as frequencies and the like.

On the other hand, a communication apparatus requires only a small space for loading the surface mounting antenna apparatus of the present invention, thereby making the presence of the antenna substantially unnoticeable from the exterior.

Other features and advantages of the present invention will become apparent from the following description of the invention which refers to the accompanying drawings.

DETAILED DESCRIPTION OF EMBODIMENTS OF THE INVENTION

Figure 1:
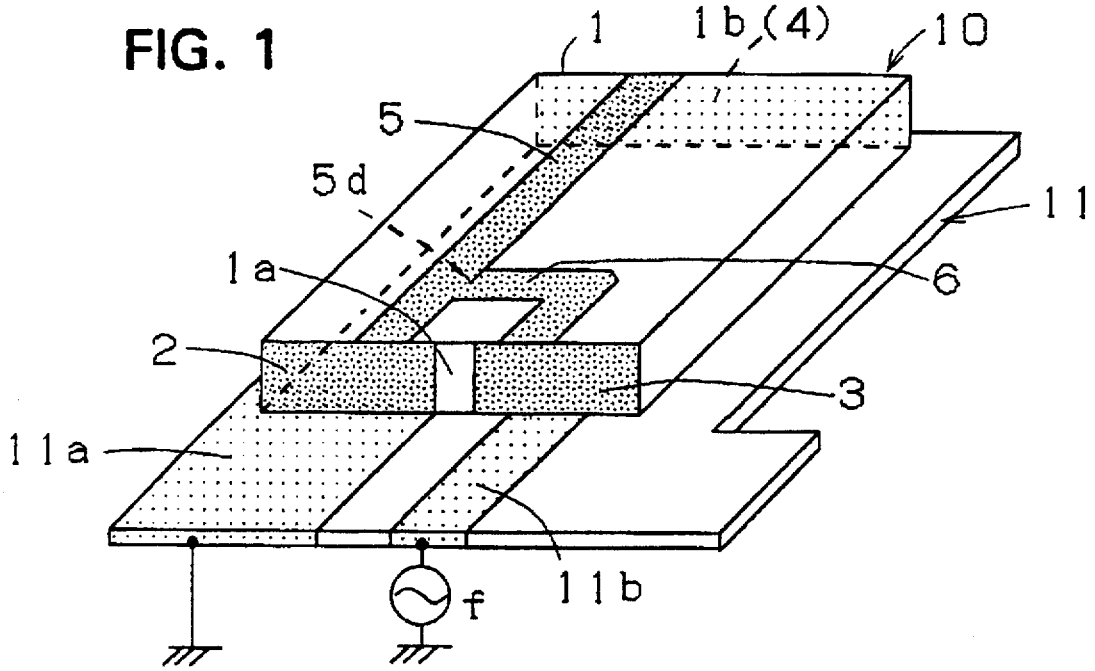
FIG. 1 is a perspective view of a surface mounting antenna according to a first embodiment of the present invention.

Embodiments of the present invention will now be described with reference to the drawings. Referring to FIG. 1 illustrating a first embodiment of the present invention, a surface mounting antenna generally designated by 10 has a rectangular substrate 1 formed of a dielectric material, a magnetic material or the like. A ground terminal 2 and a feeding terminal 3 are separately disposed on a lateral surface 1*a* of the substrate 1. A loading capacitor electrode 4 is formed on another lateral surface 1*b* opposedly facing the lateral surface 1*a*. Disposed on the obverse surface of the substrate 1 is a stripline radiation electrode 5 connected at the respective ends to the ground electrode 2 and the loading capacitor electrode 4. Also formed on the obverse surface of the substrate 1 is a bent feeding electrode 6 connected at one end to a matching portion 5*d* of the radiation electrode 5 and at the other end to the feeding terminal 3.

The surface mounting antenna 10 constructed as described above is placed on, for example, a printed circuit board 11 on which electrodes 11*a* and 11*b* are formed. The ground terminal 2 and the feeding terminal 3 are soldered to the electrodes 11*a* and 11*b*, respectively.

Figure 6:
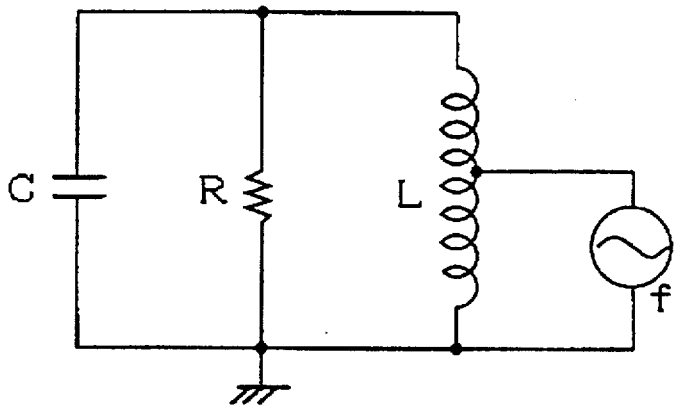
FIG. 6 is an electrical equivalent circuit of each of the embodiments shown in FIGS. 1 through 4.

The electrical equivalent circuit of the above antenna can be schematically indicated as shown in FIG. 6. A loading capacitor C generated between the ground terminal 2 and the loading capacitor electrode 4, a radiation resistor R and an inductor L of the radiation electrode 5 are connected in parallel to each other so as to form a parallel resonant circuit. A high-frequency signal f applied to the radiation electrode 5 via the electrode 11*b* of the board 11, the feeding terminal 3 and the feeding electrode 6 produces parallel resonance and is radiated as radio waves from the radiation electrode 5.

Figure 2:
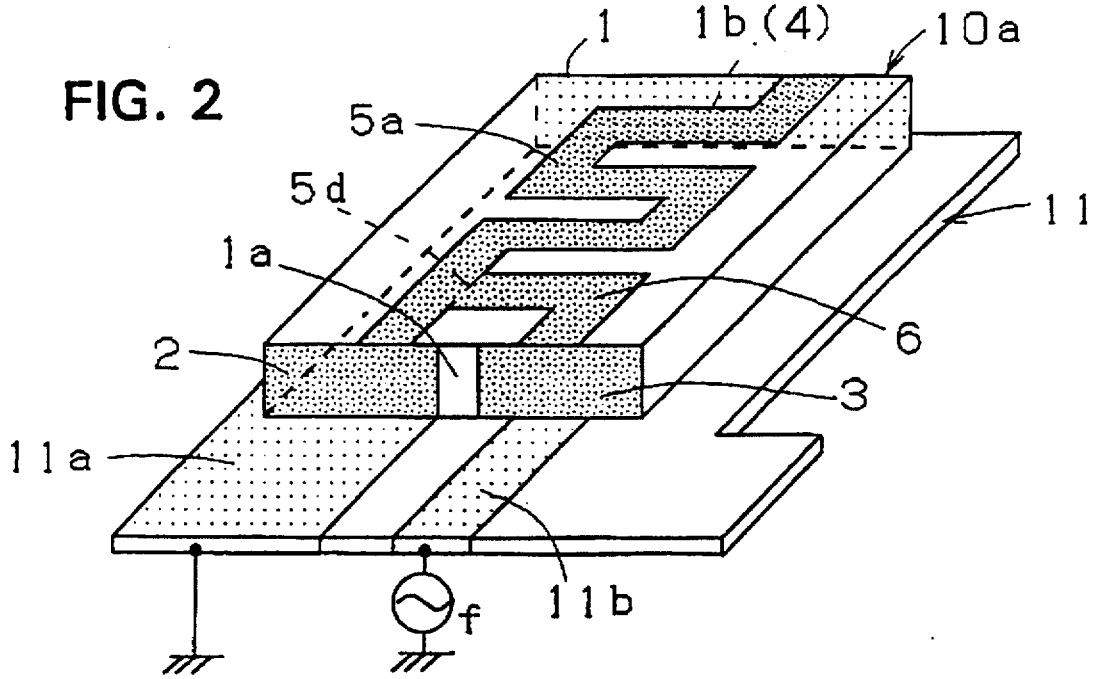
FIG. 2 is a perspective view of a surface mounting antenna according to a second embodiment of the present invention.

An explanation will now be given of a second embodiment of the present invention while referring to FIG. 2. The surface mounting antenna 10*a* of the second embodiment differs from the first embodiment in that the radiation electrode 5*a* is formed in the shape of a crankshaft. The other constructions are similar to those of the first embodiment. The same and corresponding elements as those of the first embodiment are designated by like reference numerals, and an explanation thereof will thus be omitted. The electrical equivalent circuit of the antenna 10*a* can also be indicated as illustrated in FIG. 6, as in the first embodiment.

This embodiment is advantageous over the first embodiment because the radiation electrode 5*a* is lengthened by forming it in the shape of a crankshaft so as to cope with lower frequencies having the same chip size as the first embodiment. This makes it possible to further downsize the chip size of the antenna at the same frequency as the first embodiment.

Figure 3:
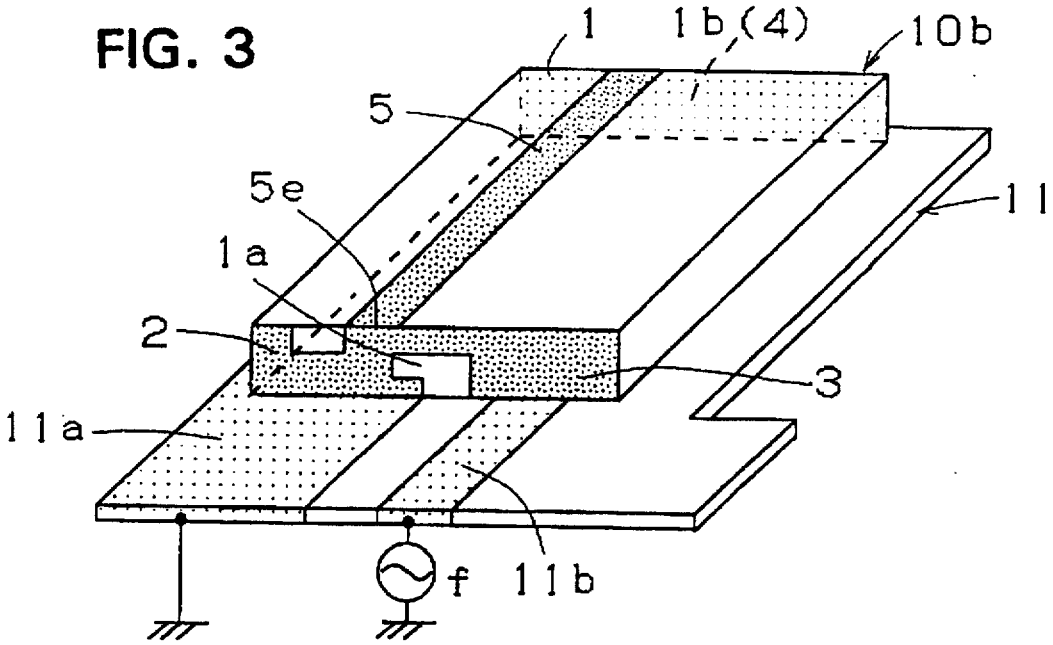
FIG. 3 is a perspective view of a surface mounting antenna according to a third embodiment of the present invention.

A third embodiment of the present invention will now be described with reference to FIG. 3. The surface mounting antenna 10*b* of the third embodiment is different from the first embodiment in that the feeding terminal 3 and the matching portion 5*e* of the radiation electrode 5 are connected to each other on the same lateral surface 1*a*, and that the ground terminal 2 and the feeding terminal 3 are connected to each other by means of a narrow electrode. The same and corresponding components similar to those of the first embodiment are designated by like reference numerals, and an explanation thereof will thus be omitted. The electrical equivalent circuit of the antenna 10*b* can also be indicated as shown in FIG. 6, as in the first embodiment.

Figure 4:
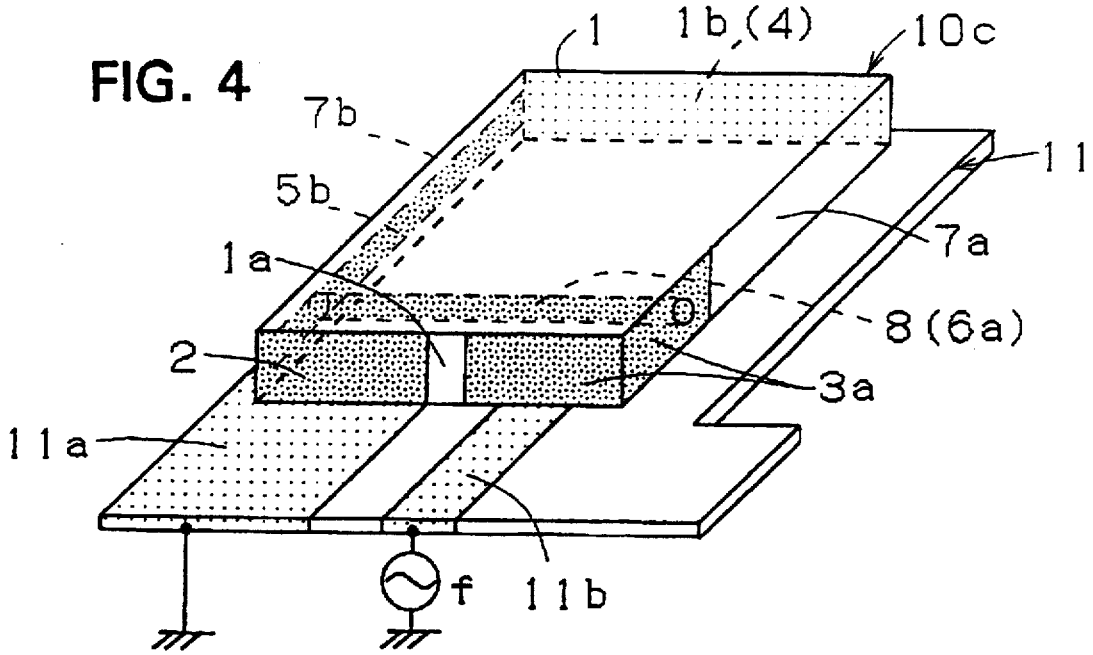
FIG. 4 is a perspective view of a surface mounting antenna according to a fourth embodiment of the present invention.

A fourth embodiment of the present invention will now be described with reference to FIG. 4. The surface mounting antenna 10*c* of this embodiment differs from the first embodiment in the following respects. The feeding terminal 3*a* is disposed across both the lateral surfaces 1*a* and 7*a* adjacent to each other, while the stripline radiation electrode 5*b* is provided on another lateral surface 7*b* close to the lateral surface 1*a*. A through hole 8 is formed from the lateral surface 7*a* to the lateral surface 7*b* so as to receive the feeding terminal 6*a* therein, which is then connected at the respective ends to the feeding terminal 3*a* and the radiation electrode 5*b*. The other constructions are similar to those of the first embodiment. The same and corresponding components similar to those of the first embodiment are depicted by like reference numerals, and an explanation thereof will thus be omitted. The electrical equivalent circuit of the antenna 10*c* can also be indicated as shown in FIG. 6, as in the first embodiment.

Figure 5:
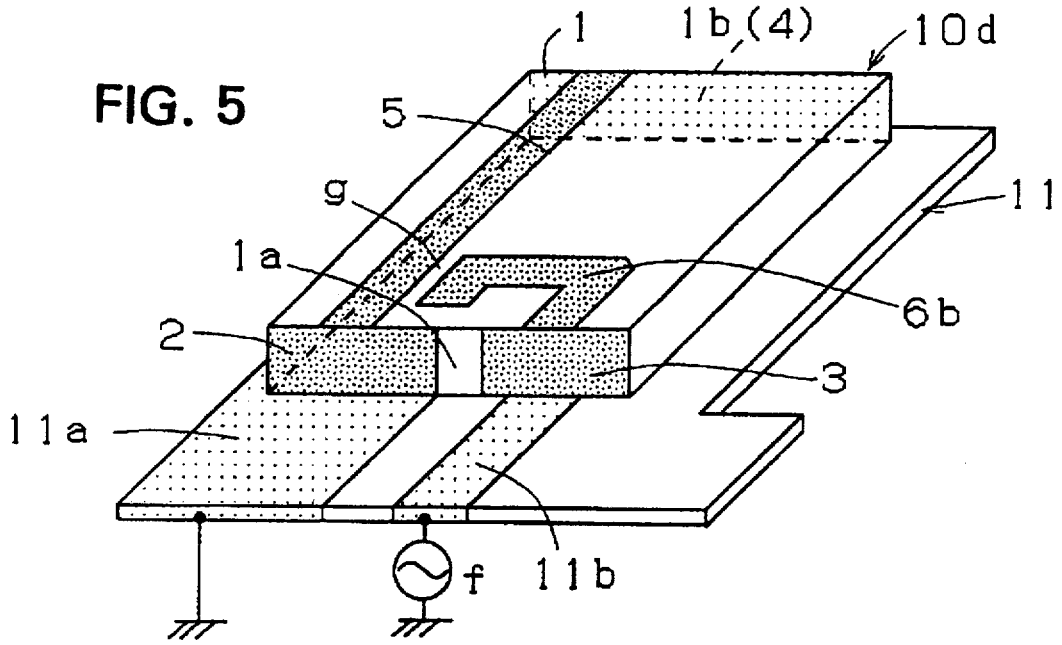
FIG. 5 is a perspective view of a surface mounting antenna according to a fifth embodiment of the present invention.

An explanation will now be given of a fifth embodiment of the present invention while referring to FIG. 5. The surface mounting antenna 10*d* of the fifth embodiment is different from the first embodiment in the following point.

Figure 7:
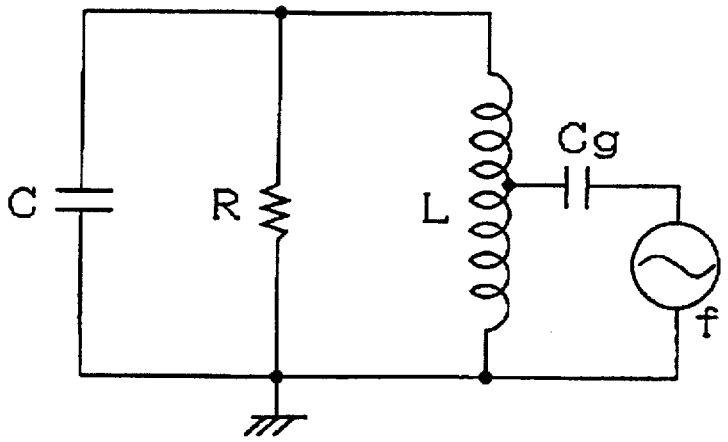
FIG. 7 is an electrical equivalent circuit of the fifth embodiment shown in FIG. 5.

The feeding electrode 6b is connected at one end to the feeding terminal 3 and is bent at the other end. The bent end of the feeding electrode 6b is placed in the vicinity of the matching portion of the radiation electrode 5 across a gap g. The feeding electrode 6b and the radiation electrode 5 are electromagnetically coupled to each other due to a capacitor generated in this gap g. The other constructions are similar to those of the first embodiment. The same and corresponding elements as those of the first embodiment are indicated by like reference numerals, and an explanation thereof will thus be omitted. The electrical equivalent circuit of this antenna 10d can be indicated as shown in FIG. 7. A series circuit of the feeding capacitor Cg of feeding portion and a high-frequency signal f is connected in parallel to a parallel circuit of a loading capacitor C, a radiation resistor R and an inductor L implemented in the electrical equivalent circuit of the first embodiment.

Figure 8:
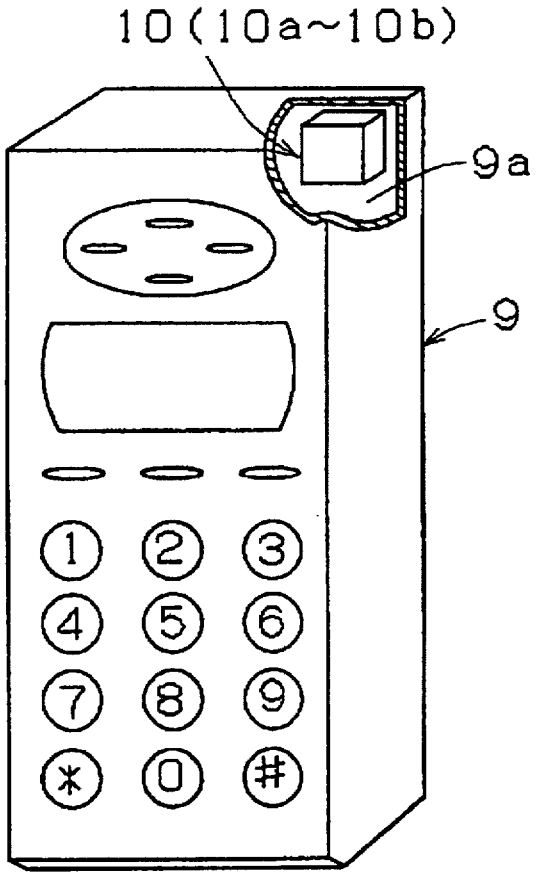
FIG. 8 is a perspective view of a communication apparatus of the present invention.
Figure 9:
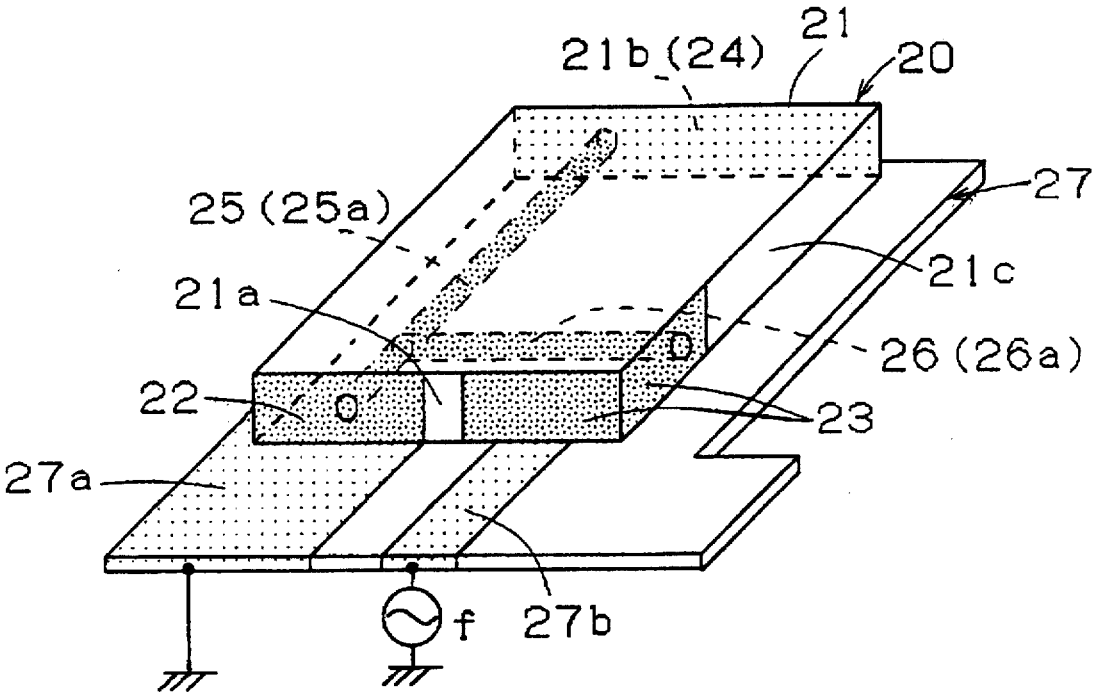
FIG. 9 PRIOR ART
FIG. 9 is a perspective view of a conventional surface mounting antenna.

FIG. 8 illustrates a communication apparatus loaded with one of the surface mounting antennae described in the respective embodiments. The surface mounting antenna 10 (10a through 10d) is mounted on a communication apparatus 9 by soldering the ground terminal 2 and the feeding terminal 3 to a printed circuit board (or its sub board) of the apparatus 9.

As will be clearly understood from the foregoing description, the present invention offers the following advantages.

A radiation electrode is formed on the surface of the substrate and a loading capacitor electrode is further disposed, thereby enhancing easy formation of the electrodes and also downsizing the antenna. To further develop the present invention, the radiation electrode is formed in a meandering shape so as to further decrease the size of the antenna. Also, since the radiation electrode and the loading capacitor electrode are disposed on the surfaces of the substrate, adjustments can be readily made to the characteristics of the antenna, such as frequencies and the like.

Further, a communication apparatus requires only a small space for loading the surface mounting antenna of the present invention, thus making the presence of the antenna substantially unnoticeable from the exterior and also downsizing the apparatus itself.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A surface mounting antenna comprising:

a substrate comprising one of a dielectric member and a magnetic member the substrate having main surfaces and lateral surfaces connecting the main surface;

a radiation electrode disposed on a main surface of said substrate and having a matching portion;

a feeding electrode disposed on the main surface of said substrate and coupled to said matching portion of said radiation electrode;

a loading capacitor electrode disposed on a lateral surface of said substrate and connected to a first end of said radiation electrode;

a ground terminal disposed on a lateral surface of the substrate other than the lateral surface on which said loading capacitor electrode is disposed, and connected to a second end of said radiation electrode; and a feeding terminal disposed on a lateral surface of the substrate other than the lateral surface on which said loading capacitor electrode is disposed, and connected to said feeding electrode.

2. A surface mounting antenna according to claim 1, wherein the feeding electrode is directly coupled to the radiation electrode at the matching portion.

3. A surface mounting antenna according to claim 1, wherein the feeding electrode is capacitively coupled to said matching portion of said radiation electrode.

4. A surface mounting antenna according to claim 3, wherein said feeding electrode is capacitively coupled to said radiation electrode across a gap.

5. A surface mounting antenna according to claim 1, wherein said radiation electrode is formed in the shape of one of a stripline, "U", meandering and a crankshaft.

6. A surface mounting antenna comprising:

a substrate comprising one of a dielectric member and a magnetic member, the substrate having main surfaces and lateral surfaces connecting the main surfaces;

a radiation electrode disposed on one main surface of said substrate and having a matching portion;

a feeding electrode disposed on the main surface of said substrate and coupled to said matching portion of said radiation electrode;

a loading capacitor electrode disposed on a lateral surface of said substrate and connected to a first end of said radiation electrode;

a ground terminal disposed on a lateral surface other than the lateral surface on which said loading capacitor electrode is disposed and connected to the other end of said radiation electrode; and at least a portion of a feeding terminal disposed on the lateral surface on which said ground electrode is disposed and connected to said feeding electrode.

7. A surface mount antenna according to claim 6, wherein the feeding electrode is directly coupled to the radiation electrode at the matching portion.

8. A surface mounting antenna according to claim 6, wherein the feeding electrode is capacitively coupled to said matching portion of said radiation electrode.

9. A surface mounting antenna according to claim 8, wherein said feeding electrode is capacitively coupled to said radiation electrode across a gap.

10. A surface mounting antenna according to claim 6, wherein said radiation electrode is formed in the shape of one of a stripline, "U", meandering and crankshaft.

11. A surface mounting antenna comprising:

a substrate formed of one of a dielectric member and a magnetic member, the substrate having main surfaces and lateral surfaces connecting the main surfaces;

a radiation electrode disposed on a first lateral surface of said substrate;

a feeding electrode disposed in an inner periphery of a through hole formed between said first lateral surface and a second lateral surface opposing said first lateral surface;

a loading capacitor electrode disposed on a lateral surface adjacent to said first lateral surface and connected to a first end of said radiation electrode;

a ground terminal disposed on another lateral surface adjacent to said first lateral surface and connected to a second end of said radiation electrode; and a feeding terminal disposed on at least said second lateral surface and connected to said feeding electrode.

12. A communication apparatus provided with a surface mounting antenna, the antenna comprising:

a substrate formed of one of a dielectric member and a magnetic member, the substrate having main surfaces and lateral surfaces connecting the main surfaces;

a radiation electrode disposed on a main surface of said substrate and having a matching portion;

a feeding electrode disposed on the main surface of said substrate and coupled to said matching portion of said radiation electrode;

a loading capacitor electrode disposed on one lateral surface of said substrate and connected to a first end of said radiation electrode;

a ground terminal disposed on a lateral surface of the substrate other than the lateral surface on which said loading capacitor electrode is disposed, and connected to the second end of said radiation electrode; and a feeding terminal disposed on a lateral surface of the substrate other than the lateral surface on which said loading capacitor electrode is disposed, and connected to said feeding electrode.

13. The apparatus according to claim 12, wherein the feeding electrode is directly coupled to the radiation electrode at the matching portion.

14. The apparatus according to claim 12, wherein the feeding electrode is capacitively coupled to said matching portion of said radiation electrode.

15. The apparatus according to claim 14, wherein said feeding electrode is capacitively coupled to said radiation electrode across a gap.

16. The apparatus according to claim 12, wherein said radiation electrode is formed in the shape of one of a stripline, "U", meandering and a crankshaft.

17. A communication apparatus provided with a surface mounting antenna, the apparatus comprising:

a substrate formed of one of a dielectric member and a magnetic member, the substrate having main surfaces and end surfaces connecting the main surfaces;

a radiation electrode disposed on one main surface of said substrate and having a matching portion;

a feeding electrode disposed on the main surface of said substrate and coupled to said matching portion of said radiation electrode;

a loading capacitor electrode disposed on a lateral surface of said substrate and connected to a first end of said radiation electrode;

a ground terminal disposed on a lateral surface other than the lateral surface on which said loading capacitor electrode is disposed, and connected to the second end of said radiation electrode; and at least a portion of a feeding terminal disposed on the lateral surface on which said ground electrode is disposed, and connected to said feeding electrode.

18. The apparatus according to claim 17, wherein the feeding electrode is directly coupled to the radiation electrode at the matching portion.

19. The apparatus according to claim 17, wherein the feeding electrode is capacitively coupled to said notching portion of said radiation electrode.

20. The apparatus according to claim 19, wherein said feeding electrode is capacitively coupled to said radiation electrode across a gap.

21. The apparatus according to claim 17, wherein said radiation electrode is formed in the shape of one of a stripline, "U", meandering and a crankshaft.

22. A communication apparatus provided with a surface mounting antenna, the antenna comprising:

a substrate formed of a one of dielectric member and a magnetic member, the substrate having main surfaces and lateral surfaces connecting the main surfaces;

a radiation electrode disposed on a first lateral surface of said substrate;

a feeding electrode disposed in an inner periphery of a through hole formed between said first lateral surface and a second lateral surface opposing said first lateral surface;

a loading capacitor electrode disposed on a lateral surface adjacent to said first lateral surface and connected to a first end of said radiation electrode;

a ground terminal disposed on another lateral surface adjacent to said first lateral surface and connected to a second end of said radiation electrode; and a feeding terminal disposed on at least said second lateral surface and connected to said feeding electrode.

23. A surface mounting antenna comprising:

a substrate comprising one of a dielectric member and magnetic member the substrate having main surfaces and lateral surfaces connecting the main surfaces;

a radiation electrode disposed on one main surface of said substrate and continuing onto a lateral surface of said substrate and having a matching portion on said lateral surface;

a feeding electrode disposed on the lateral surface of said substrate on which a portion of the radiation electrode is disposed and being coupled to said matching portion of said radiation electrode;

a loading capacitor electrode disposed on a lateral surface of said substrate and connected to a first end of said radiation electrode;

a ground terminal disposed on a lateral surface of the substrate and connected to a second end of said radiation electrode; and a feeding terminal disposed on a lateral surface of the substrate and connected to said feeding electrode.

24. A communication apparatus provided with a surface mounting antenna, the antenna comprising:

a substrate comprising one of a dielectric member and magnetic member the substrate having main surfaces and lateral surfaces connecting the main surfaces;

a radiation electrode disposed on a main surface of said substrate and continuing onto a lateral surface of said substrate and having a matching portion on said lateral surface;

a feeding electrode disposed on the lateral surface of said substrate on which a portion of the radiation electrode is disposed and being coupled to said matching portion of said radiation electrode;

a loading capacitor electrode disposed on a lateral surface of said substrate and connected to a first end of said radiation electrode;

a ground terminal disposed on a lateral surface of the substrate and connected to a second end of said radiation electrode; and a feeding terminal disposed on a lateral surface of the substrate and connected to said feeding electrode.

25. A surface mounting antenna comprising:

a substrate comprising one of a dielectric member and a magnetic member the substrate having main surfaces and lateral surfaces connecting the main surfaces;

a radiation electrode disposed on a main surface of said substrate and having a matching portion;

a feeding electrode disposed on the main surface of said substrate and coupled to said matching portion of said radiation electrode;

a loading capacitor electrode disposed on a lateral surface of said substrate and connected to a first end of said radiation electrode;

a ground terminal disposed on a lateral surface of the substrate and connected to a second end of said radiation electrode; and a feeding terminal disposed on a lateral surface of the substrate and connected to said feeding electrode.

26. A surface mounting antenna according to claim 25, wherein the feeding electrode is directly coupled to the radiation electrode at the matching portion.

27. A surface mounting antenna according to claim 25, wherein the feeding electrode is capacitively coupled to said matching portion of said radiation electrode.

28. A surface mounting antenna according to claim 27, wherein said feeding electrode is capacitively coupled to said radiation electrode across a gap.

29. A communication apparatus provided with a surface mounting antenna, the antenna comprising:

a substrate comprising one of a dielectric member and a magnetic member the substrate having main surfaces and lateral surfaces connecting the main surfaces;

a radiation electrode disposed on a main surface of said substrate and having a matching portion;

a feeding electrode disposed on the main surface of said substrate and coupled to said matching portion of said radiation electrode;

a loading capacitor electrode disposed on a lateral surface of said substrate and connected to a first end of said radiation electrode;

a ground terminal disposed on a lateral surface of the substrate and connected to a second end of said radiation electrode; and a feeding terminal disposed on a lateral surface of the substrate and connected to said feeding electrode.

30. The apparatus according to claim 29, wherein the feeding electrode is directly coupled to the radiation electrode at the matching portion.

31. The apparatus according to claim 29, wherein the feeding electrode is capacitively coupled to said notching portion of said radiation electrode.

32. The apparatus according to claim 31, wherein said feeding electrode is capacitively coupled to said radiation electrode across a gap.

* * * * *